US006707358B1

(12) United States Patent
Massman

(10) Patent No.: US 6,707,358 B1
(45) Date of Patent: Mar. 16, 2004

(54) HIGH CURRENT BISTABLE RELAY WITH ARC SUPPRESSION

(75) Inventor: Sally A. Massman, Eagle, WI (US)

(73) Assignee: Deltrol Controls, Milwaukee, WI (US)

( * ) Notice: Subject to any disclaimer, the term of this patent is extended or adjusted under 35 U.S.C. 154(b) by 16 days.

(21) Appl. No.: 10/300,557

(22) Filed: Nov. 20, 2002

(51) Int. Cl.[7] ..... H01H 67/02
(52) U.S. Cl. ..... 335/132; 200/242
(58) Field of Search ..... 335/78, 185, 83–86, 335/133, 194, 196, 197, 183; 200/242, 253

(56) References Cited

U.S. PATENT DOCUMENTS

| | | | | |
|---|---|---|---|---|
| 3,613,036 A | * | 10/1971 | Kurtz | 335/196 |
| 4,593,260 A | * | 6/1986 | Guero et al. | 335/195 |
| 4,700,026 A | * | 10/1987 | Kamiyama et al. | 200/19.07 |
| 4,739,293 A | * | 4/1988 | Hurley et al. | 335/132 |
| 4,747,010 A | * | 5/1988 | Bayer | 361/210 |
| 5,917,162 A | * | 6/1999 | Jackman | 200/61.45 R |
| 6,084,488 A | | 7/2000 | Macbeth et al. | |
| 6,377,143 B1 | * | 4/2002 | Zhou et al. | 335/132 |

FOREIGN PATENT DOCUMENTS

| | | | | |
|---|---|---|---|---|
| JP | 63126136 A | * | 5/1988 | H01H/73/18 |

* cited by examiner

*Primary Examiner*—Lincoln Donovan
*Assistant Examiner*—Bernard Rojas
(74) *Attorney, Agent, or Firm*—Andrus, Sceales, Starke & Sawall, LLP

(57) ABSTRACT

A relay has a pair of fixed contacts, a pair of movable contacts adapted to be engaged and disengaged with the fixed contacts, and a solenoid having a coil and a plunger movable into and out of the solenoid, the plunger having an outer end operably connected to the movable contacts. The relay can maintain either of two stable positions in the absence of power to the coil, the two positions being a contact open or magnetically latched position and a closed or unlatched position. The invention is improved by a ball joint arrangement interconnecting the plunger and the movable contacts to enable wiping of the contacts on closure to remove thin film tarnish caused by oxidation of the Nobel metal contacts and to produce a torsional force which facilitates breaking of welds on opening. An insulator surrounds the movable contacts for cooling the arcing and magnetic fields are oriented with respect to the current in the contacts in a manner that applies a force on the current in the direction of the insulator.

19 Claims, 6 Drawing Sheets

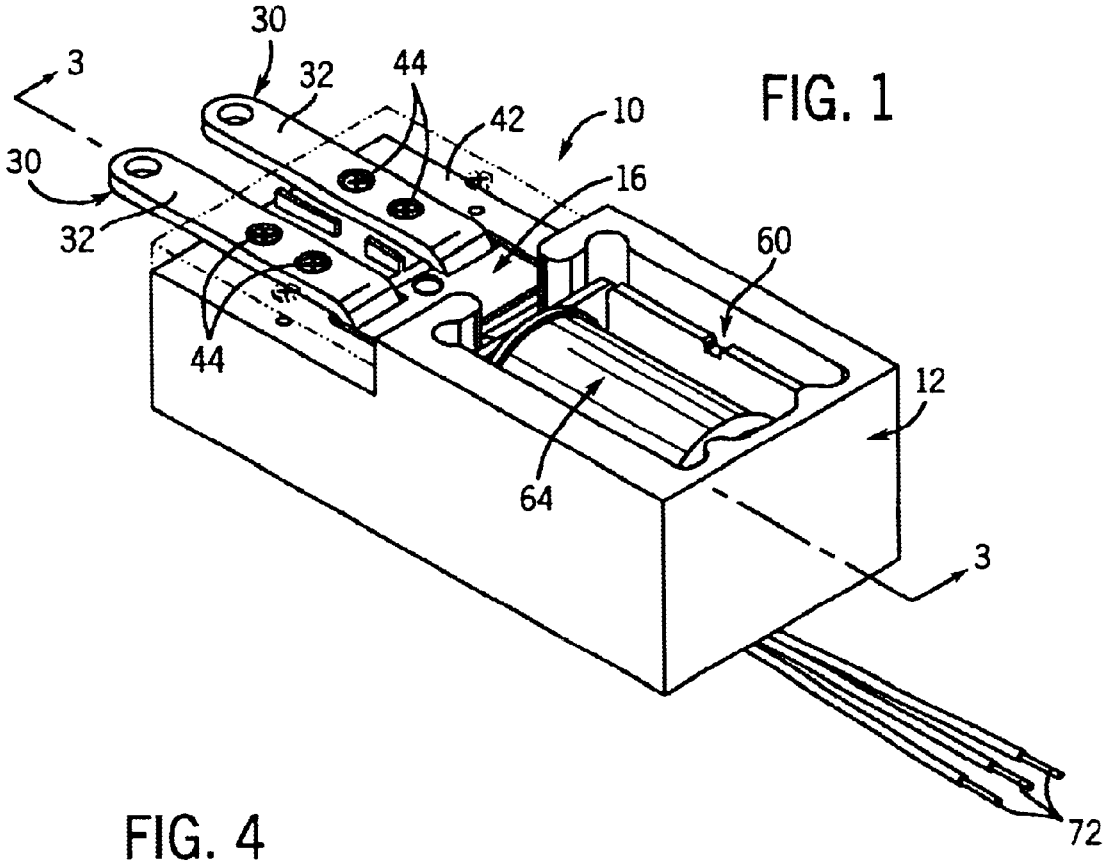
FIG. 1
FIG. 4
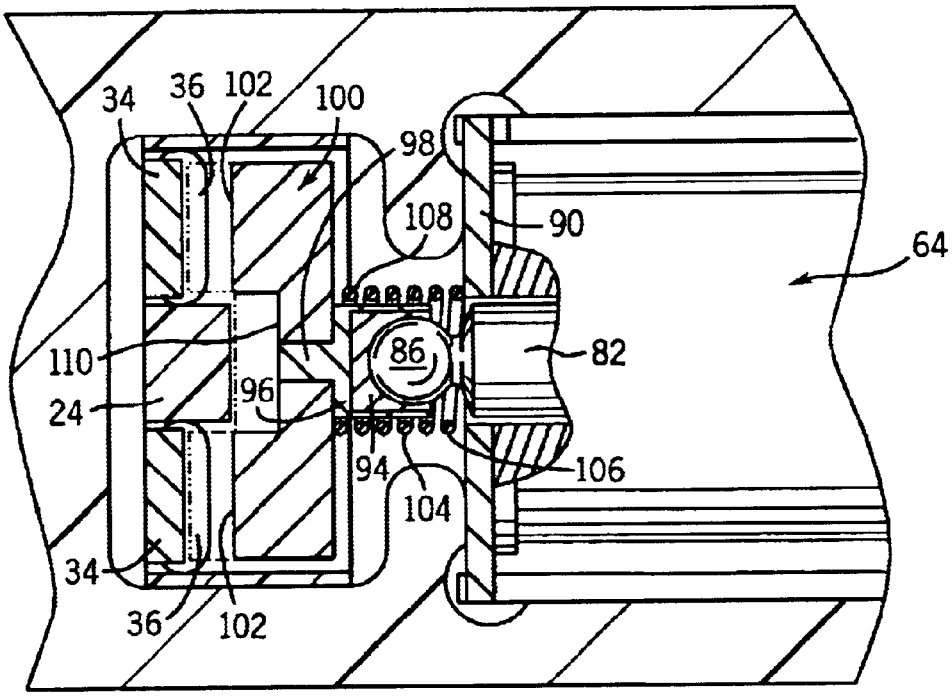

HIGH CURRENT BISTABLE RELAY WITH ARC SUPPRESSION

FIELD OF THE INVENTION

This invention relates broadly to electromechanical control devices and, more particularly, pertains to a compact, high current, low resistance, bistable relay particularly useful in handling the electrical requirements of a growing number of automotive accessories expected to be operated at voltages exceeding the current standard 24 volts dc.

BACKGROUND OF THE INVENTION

As explained in U.S. Pat. No. 6,084,488 issued to Macbeth et al., Jul. 4, 2000, electromechanical relays of the type with which this invention is concerned include one or more pairs of movable contacts that can be selectively brought into engagement to complete an electrical circuit called "contact make", or moved apart, called "contact break", to open the circuit. During either make or break when the contacts are at some very small separation ($<1\times10^{-6}$ m), an arc is formed. A variety of techniques have been employed in the past to minimize the amount of arcing, and/or compensate for the arcing, to provide a relay that continues to operate effectively.

When an arc occurs, it is common for material to be transferred from one relay contact to another, and in many cases, an actual weld, albeit a small one, is formed between the contacts. In normally open contacts, for example, if a weld is formed between contacts when the contacts are closed, the weld may tend to hold the contacts closed when operating forces are removed, and this may prevent the relay from opening as desired. Typically, electromechanical relays include a solenoid for physically bringing the contacts together, and rely on a spring to force the contacts open when the solenoid is deenergized.

It is common to arrange relay contacts so that they engage and/or separate with a combination of relative movements, including opening and closing movements generally perpendicular to the surfaces of the contacts, and wiping movements generally transverse to the surface. The relative wiping movement of the contacts reduces the tendency for arcing to create strong welds during closure and adds a torsional force to help break welds on demand to open, therefore making the relay more reliable. In addition, and equally important for reliability and high performance in systems requiring a very low resistance device, a properly designed contact wipe will remove the thin but high resistance tarnish film which occurs on Nobel metals.

In the aforementioned '488 patent, a compact high current relay is provided having first and second fixed contacts connected in circuit relationship with the apparatus to be controlled. An elongated bus bar has first and second movable contacts at opposite ends thereof, the bus bar characterized by a stiffness such that upon application of a first predetermined force to the bus bar between the contacts, the bus bar flexes and the movable contacts both tilt and wipe with respect to the first and second fixed contacts. A solenoid is connected to the bus bar between the first and second contacts for exerting a force on the bus bar greater than the predetermined force.

While the Macbeth et al. patent is generally satisfactory for relays with a flexible bus bar design, it remains desirable to provide a differently styled relay having unique structure to suppress arcing, to allow wiping of the contacts as the contacts are closed, and to apply a strong torsional force to the contacts on opening. Minimization of both the total resistance across the device and the power required to hold the device in either the contact open or the contact closed state are also desired.

SUMMARY OF THE INVENTION

It is a general object of the present invention to provide an arc suppressing high current relay with enhanced DC interruption capability at voltages exceeding those of typical relays.

It is also an object of the present invention to provide an insulator receiving structure for the fixed contacts of the relay that will enable cooling of the arc.

It is an additional object of the present invention to provide a means to move the arc towards the insulator in order to enhance cooling.

It is an additional object of the present invention to provide an improved movable contact assembly which will effectively wipe the fixed contacts of the relay in a manner that prevents tarnish build up between the contacts and also minimize the chance of hard welds.

It is an additional object of the present invention to provide an improved movable contact assembly that will provide a torsional component of force and increase the weld break capability of the device on contact break.

It is an additional object of the current invention to provide a device which can remain fixed in either the open or closed position after being commanded there by the coil and the power to the coil is subsequently removed.

In one aspect of the invention, there is provided a relay subject to arcing when contacts make or break, and susceptible to welding and erosion due to arcing. The relay includes a solenoid having a plunger movable into and out of the solenoid. The solenoid is comprised of two sets of windings such that power may be applied to the solenoid to create a field with the north pole towards the contacts in the one instance and with the south pole directed towards the contacts in the other. A permanent magnet with a field which could be oriented either such that its north pole faces towards the contacts or that its south pole faces the contacts, is included in the magnetic circuit with the plunger part of its magnetic path. Upon application of power to the solenoid that provides a supplemental field to the magnet, the plunger will move into the solenoid and latch. Upon subsequently removing the power to the solenoid the device will remain in the latched position. Upon application of power to the solenoid creating a field opposing the permanent magnet, the plunger will unlatch and move forward out of the solenoid. Upon subsequent removal of power to the solenoid the solenoid will remain in its forward position. A pair of fixed contacts is provided along with a movable bridge assembly having a pair of movable contacts adapted to engage and disengage the fixed contacts upon unlatch and latch of the plunger. The bridge assembly is connected via a ball joint arrangement to the solenoid plunger, the ball joint arrangement enabling the movable contact to move laterally with respect to the stationary contact causing contact wipe to occur and thin film tarnish to be removed from the contacts on closing. Additionally, the ball joint arrangement provides a torsional force to break welds on opening. An insulator surrounds the movable contacts for cooling the arc between the movable and fixed contacts. The solenoid is supported in a generally rectangular frame having an end plate. The fixed contacts are carried on outwardly and downwardly angled legs of a pair of generally L-shaped brackets. The relay has a housing for supporting the solenoid in its frame, the insulator, the movable bridge assembly and the L-shaped brackets. The contacts and contact bus are oriented relative to the field of the permanent magnet and opening solenoid such that a current through the opening contacts will experience a force due to that field. The contacts and contact bus are also oriented such that a current through them will also experience a force due to their "self field." The force experienced by the current due to the permanent magnet and the solenoid will supplement the force due to the self field for current flowing in one direction and partially supplement it and partially oppose it for current flowing in the opposite direction. The force of the self-field on the current is towards the insulator regardless of the direction of the current flow. The plunger has a cylindrical portion and a spherical portion. The spherical portion is received within a swivel cap attached to the movable bridge assembly to define a swivel arrangement for the movable contacts on the bridge assembly. The insulator is preferably constructed of LEXAN polycarbonate. The relay housing has one cavity for holding the solenoid in its frame, and another cavity for holding the insulator, the movable bridge assembly and the angled legs of the L-shaped brackets. The insulator is formed with pockets for receiving lowermost ends of the angled legs of the L-shaped brackets. The L-shaped brackets include horizontal legs integrally connected to the outwardly and downwardly angled legs. The outwardly and downwardly angled legs are disposed at an angle of about 95 degrees relative to the horizontal legs. A coil spring has one end disposed against the end plate and a second end disposed against a rearward end of the bridge assembly.

In another aspect of the invention, a relay has a pair of fixed contacts, a pair of movable contacts adapted to be engaged and disengaged with the fixed contacts, and a solenoid having a plunger movable into and out of the solenoid, the plunger having an outer end operably connected to the movable contacts. The invention is improved by a motion translating and preferably a ball joint arrangement interconnecting the plunger and the movable contacts to enable wiping of the contacts on make to remove thin film tarnish and to provide torsional force to aid in the breaking of welds on opening. The invention is further improved by an insulator surrounding the movable contacts for cooling the arcing. The ball joint arrangement provides for swivel movement of the movable contacts. The ball joint arrangement includes a spherical portion formed on one end of the plunger, a cylindrical swivel cap liner for receiving the spherical portion of the plunger, and a cylindrical swivel cap for receiving the liner, the swivel cap being attached to the movable contacts. The insulator includes a top wall overlying the movable contacts. The fixed contacts are carried on outwardly and downwardly angled legs that are received in a pair of pockets formed in the insulator. The insulator is constructed of a gas expelling material. The contacts and contact bus are oriented relative to the field of the permanent magnet and opening solenoid such that a current through the opening contacts will experience a force due to that field. The contacts and contact bus are also oriented such that a current through them will also experience a force due to their "self field." The force experienced by the current due to the permanent magnet and the solenoid will supplement the force due to the self field for current flowing in one direction and partially supplement it and partially oppose it for current flowing in the opposite direction. The force of the self-field on the current is towards the insulator regardless of the direction of the current flow.

In yet another aspect of the invention, a relay includes a solenoid having a plunger movable into and out of the solenoid. The solenoid is comprised of two sets of windings such that power may be applied to the solenoid to create a field with the north pole towards the contacts in the one instance and with the south pole directed towards the contacts in the other. A permanent magnet with a field which could be oriented either such that its north pole faces towards the contacts or that its south pole faces the contacts, is included in the magnetic circuit with the plunger part of its magnetic path. Upon application of power to the solenoid that provides a supplemental field to the magnet, the plunger will move into the solenoid and latch. Upon subsequently removing the power to the solenoid the device will remain in the latched position. Upon application of power to the solenoid creating a field opposing the permanent magnet, the plunger will unlatch and move forward out of the solenoid. Upon subsequent removal of power to the solenoid the solenoid will remain in its forward position. A frame is provided for holding the solenoid. A pair of generally L-shaped brackets has horizontal legs integrally formed with outwardly and downwardly angled legs carrying a pair of fixed contacts. A movable bridge assembly is provided with a pair of movable contacts adapted to engage and disengage the fixed contacts upon respective unlatch and latch of the plunger. The bridge assembly is connected via a ball joint arrangement to the solenoid plunger. The ball joint arrangement enables wiping of the contacts and removal of thin film tarnish on make and also provides a torsional force to aid in breaking of welds on opening. A coil spring surrounds the ball joint arrangement and has one end disposed against the frame and another end disposed against the bridge assembly. An insulator surrounds the movable contacts for cooling the arc. The contacts and contact bus are oriented relative to the field of the permanent magnet and opening solenoid such that a current through the opening contacts will experience a force due to that field. The contacts and contact bus are also oriented such that a current through them will also experience a force due to their "self field." The force experienced by the current due to the permanent magnet and the solenoid will supplement the force due to the self field for current flowing in one direction and partially supplement it and partially oppose it for current flowing in the opposite direction. The force of the self field on the current is towards the insulator regardless of the direction of the current flow.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is a perspective view of a high voltage relay embodying the present invention with its cover removed;

FIG. 4 is an enlarged, partial sectional view taken on line 4—4 of FIG. 3;

DETAILED DESCRIPTION OF THE INVENTION

Figure 2:
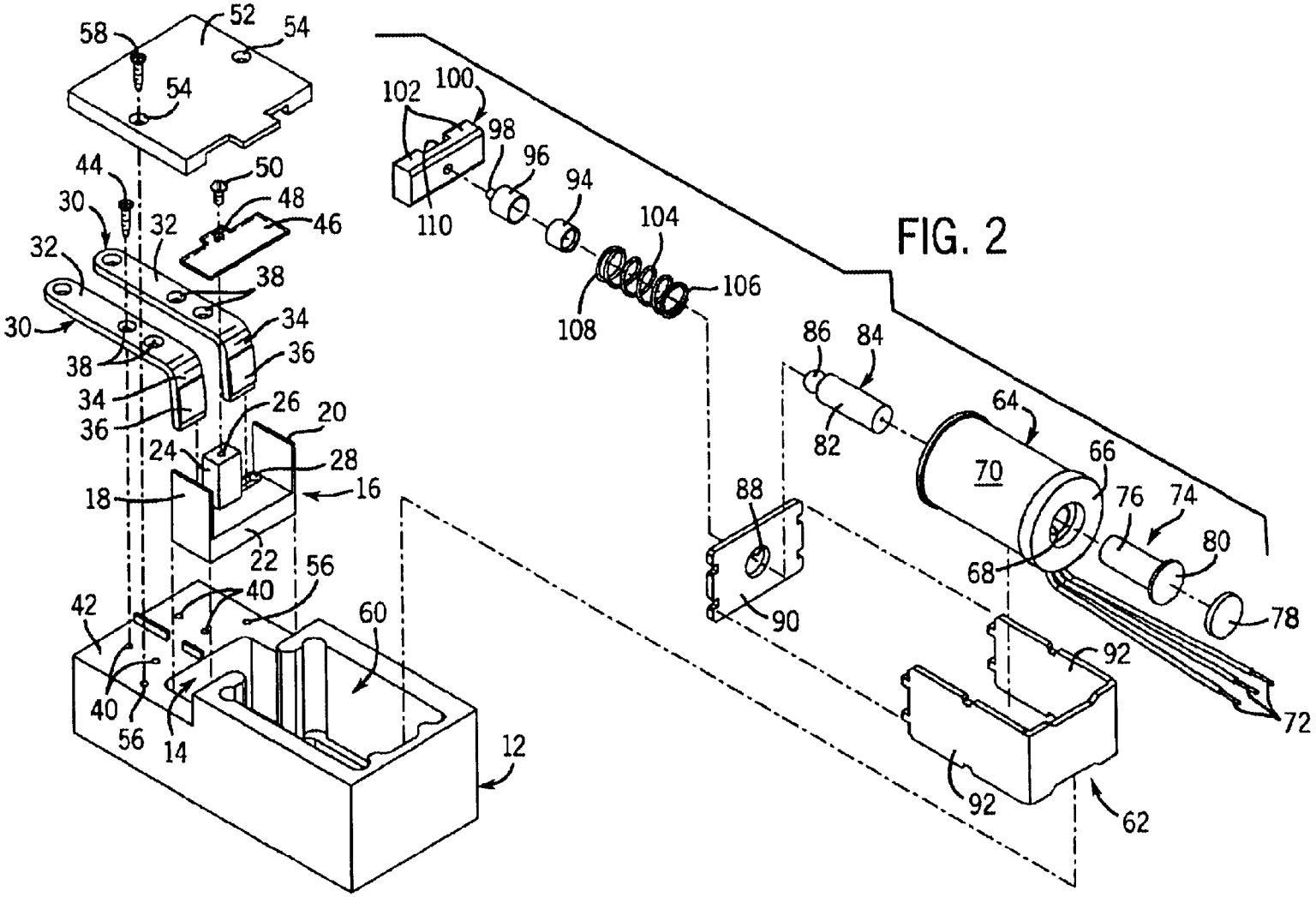
FIG. 2 is an exploded, perspective view of the components of the high voltage relay of FIG. 1.
Figure 3:
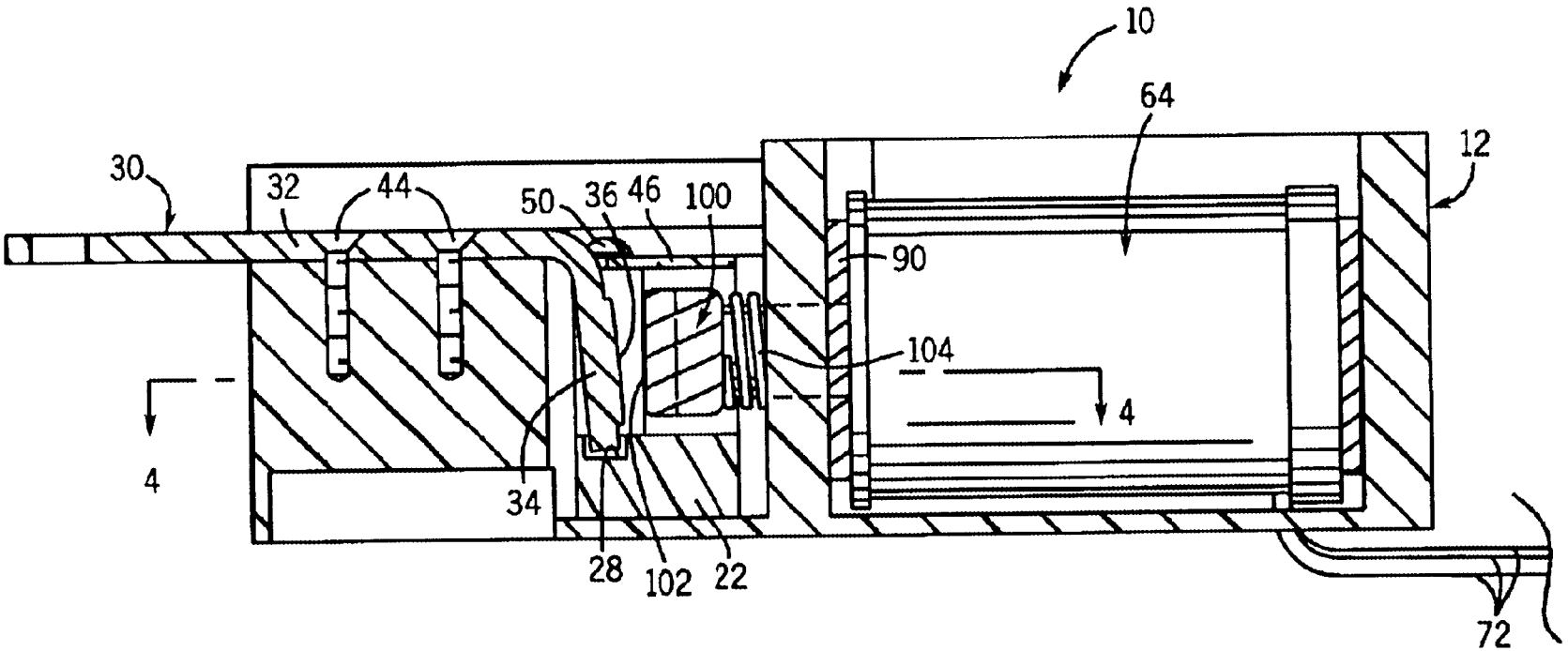
FIG. 3 is an enlarged, sectional view taken on line 3—3 of FIG. 1.

Referring now to the drawings, FIGS. 1 through 3 illustrate a high voltage relay 10 such as may be used in the electrical system of a vehicle. Relay 10 includes a generally rectangular housing 12 having a first cavity 14 (FIG. 2) for receiving an insulator 16 having a pair of side walls 18, 20 integrally connected to a base 22. A rearward end in base 22 is formed with an upstanding pillar 24 having a threaded aperture 26 extending throughout its height. A pair of pockets 28, one on each side of the pillar 24, is also provided in the base 22 of the insulator 16. As one feature of the invention, the insulator 16 is formed of a clear material made of LEXAN polycarbonate which has been found to improve the performance of the relay 10 as will be further described below. While LEXAN polycarbonate is used in the preferred embodiment, it should be understood that other suitable materials may also be chosen that provide similar off gassing properties. The pockets 28 in insulator 16 disposed in the first cavity 14 receive the lowermost ends of a pair of generally L-shaped brackets 30 having horizontal legs 32, and outwardly and downwardly bent legs 34 which carry a pair of fixed contacts 36. Horizontal legs 32 are each formed with a pair of apertures 38 which are aligned with a pair of threaded holes 40 on a rear deck 42 of the housing 12. Suitable fasteners 44 are provided which are passed through the aligned apertures 38 and secured into the holes 40 to fasten the L-shaped brackets 30 to the housing 12 with their lowermost ends protruding into the pockets 28 in the insulator 16.

As can be seen best in FIG. 3, the legs 34 carrying the fixed contacts 36 are bent an angle of about 95 degrees relative to the horizontal legs 32 to facilitate particular engagement with a movable contact structure to be described. A generally T-shaped top wall 46 has a through hole 48 which is registerable with the aperture 26 in the pillar 24 so that it can be attached between the top of the side walls 18, 20 of the insulator 16 by a fastener 50. A generally rectangular cover 52 has a pair of holes 54 alignable with a pair of apertures 56 on the deck 42 of the housing 12. A pair of fasteners (one being shown at 58) is passed through the holes 54 and threaded into the apertures 56 to secure the cover 52 over the insulator 16 and a major portion of the L-shaped bracket horizontal legs 32.

The relay housing 12 also has a second cavity 60 for accommodating a solenoid arrangement including a generally U-shaped frame 62, which receives a solenoid 64. The solenoid 64 has a bobbin 66 with a through passage 68, a coil (not shown) wrapped around the bobbin 66, and a protective covering 70 surrounding the coil. A set of electrical wires 72 adapted to be connected to a source of electrical power extends from the coil. The solenoid 64 also includes a backstop 74 having a cylindrical portion 76 which is inserted into one end of the bobbin passage 68 and a solenoid holding magnet 78 which is attached to a circular top 80 of the backstop 74. The other end of the bobbin passage 68 receives a cylindrical portion 82 of a plunger 84 known to be moved in and out of the solenoid 64 as power to the coil is applied in a sense that produce fields that respectively aid and oppose the field of the magnet. Plunger 84 has the cylindrical portion 82 integrally connected with a spherical portion 86. With the cylindrical portion 82 lodged in the other end of the bobbin passage 68, the spherical portion 86 protrudes through an opening 88 in an end plate 90 which is secured to the side plates 92 of the frame 62 as seen in FIG. 4. The spherical portion 86 of plunger 84 is swivel mounted in a TEFLON resin liner 94 which fits into a swivel cap 96. The cap 96 has a projection 98 that is secured to a generally U-shaped contact bridge assembly 100 having a pair of movable contacts 102. A coil spring 104 surrounds the spherical portion 86 of plunger 84, the liner 94 and the swivel cap 96. The spring 104 has one end 106 which is disposed against the end plate 90 and another end 108 which is placed against a rear wall of the bridge assembly 100.

During assembly, the solenoid 64 along with the backstop 74, magnet 78 and the cylindrical portion 82 of the plunger 84 is held within the frame 62 with end plate 90 connected thereto and defines a solenoid arrangement which is disposed in the second cavity 60 of the relay housing 12. With the solenoid arrangement in the relay housing 12, the spherical portion 86 of the plunger 84, the cap 96 and its liner 94 project beyond the end plate 90 of frame 62, and the contact bridge assembly 100 is disposed within the insulator 16 in the first cavity 14 spaced apart from the fixed contacts 36 on the L-shaped brackets 30. Furthermore, the contact bridge assembly 100 has a central channel 110 which normally is spaced from the pillar 24 of insulator 16 when the contacts 36, 102 are in an open position as shown in FIGS. 3 and 4. As a second feature of the invention, the engagement of the spherical portion 86 of plunger 84 with the swivel cap 96 and its liner 94 defines a ball joint arrangement which permits the contact bridge assembly 100 and its movable contacts 102 to swivel in a manner which will enable a wiping action of the fixed contacts 36 as will be further appreciated hereafter.

The relay 10 is shown in its assembled condition with cover 52 removed as shown in FIGS. 1 and 3.

Figure 5:
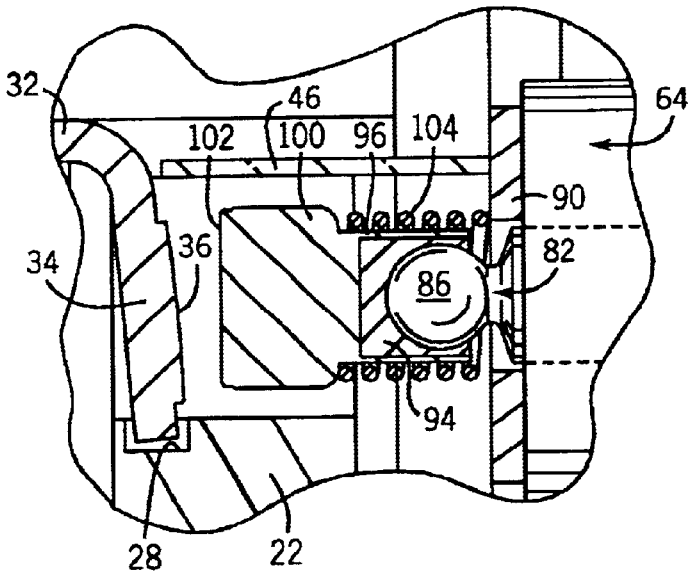
FIG. 5 is a partial view of FIG. 3 showing the fixed contacts and the movable contacts of the relay in a normally open position.
Figure 7:
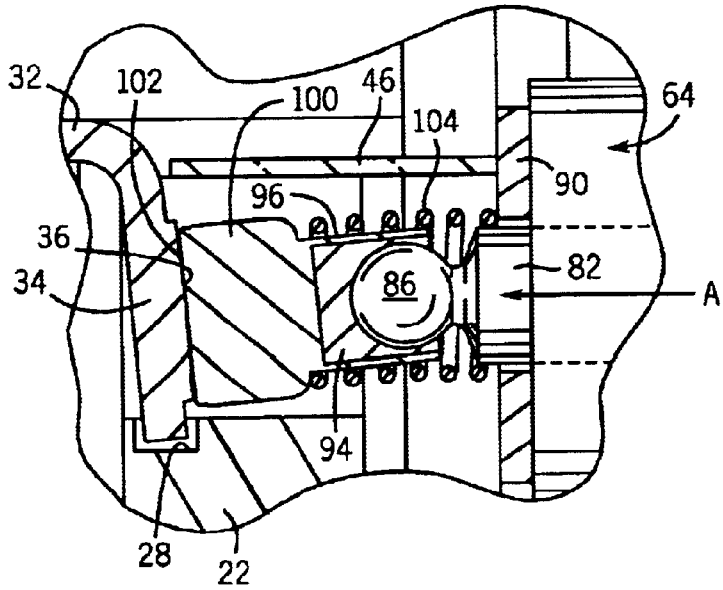
FIG. 7 is a view like FIG. 6 showing the closing of the movable contacts upon the fixed contacts.
Figure 6:
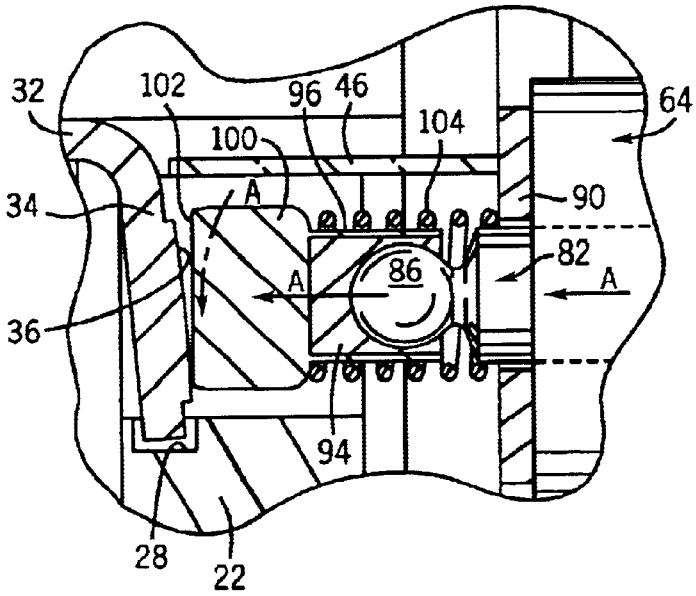
FIG. 6 is a view like FIG. 5 showing a wiping of the contacts as the movable contacts continue to move to their closed position.
Figure 10:
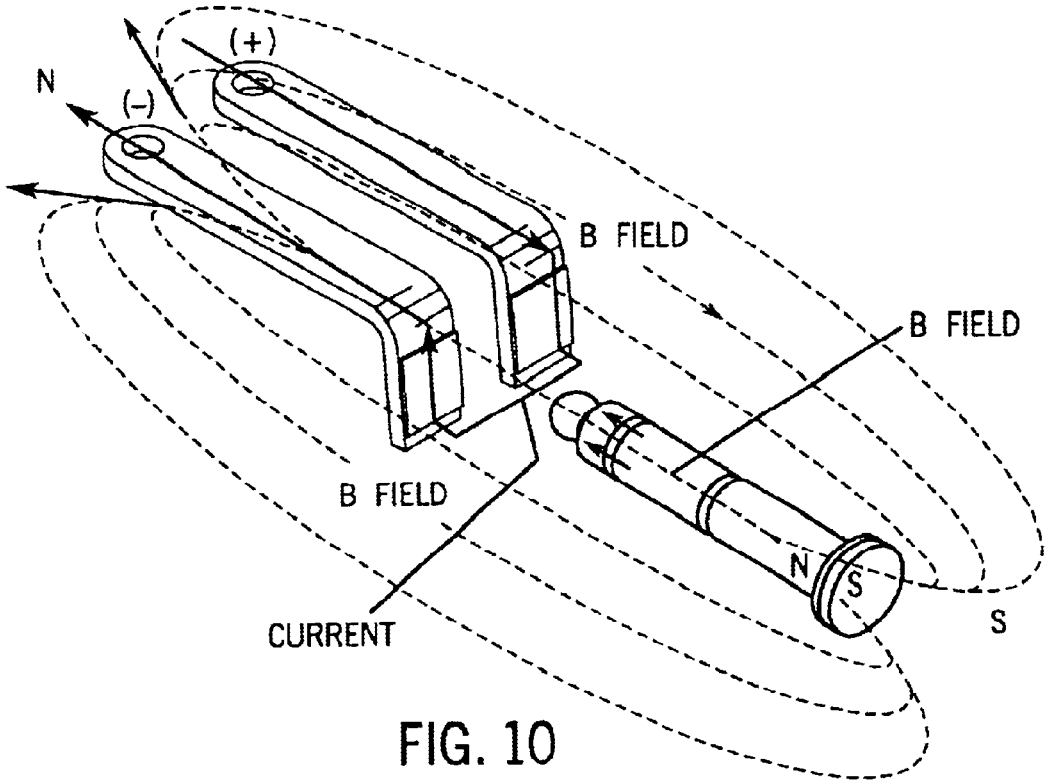
FIG. 10 is a simplified diagram depicting one desirable magnetic field orientation and current orientation.
Figure 8:
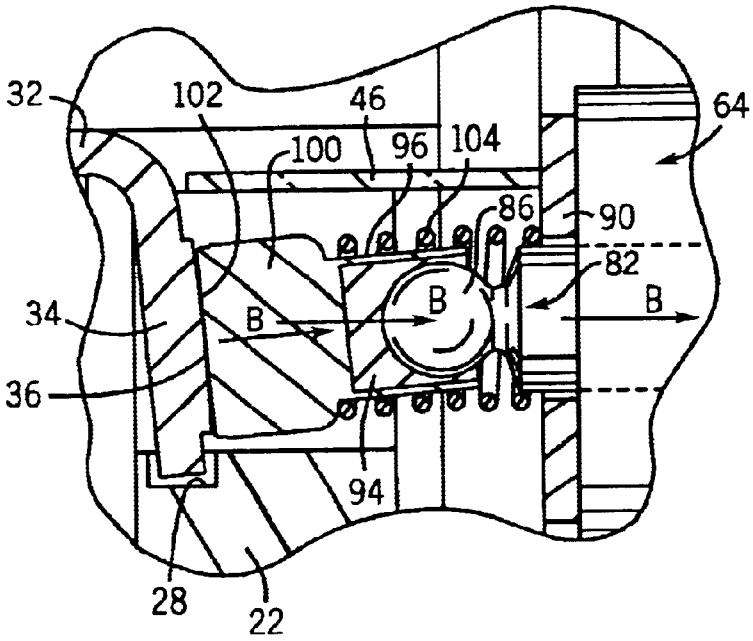
FIG. 8 is a view like FIG. 7 showing a beginning of the reopening of the movable and fixed contacts.
Figure 9:
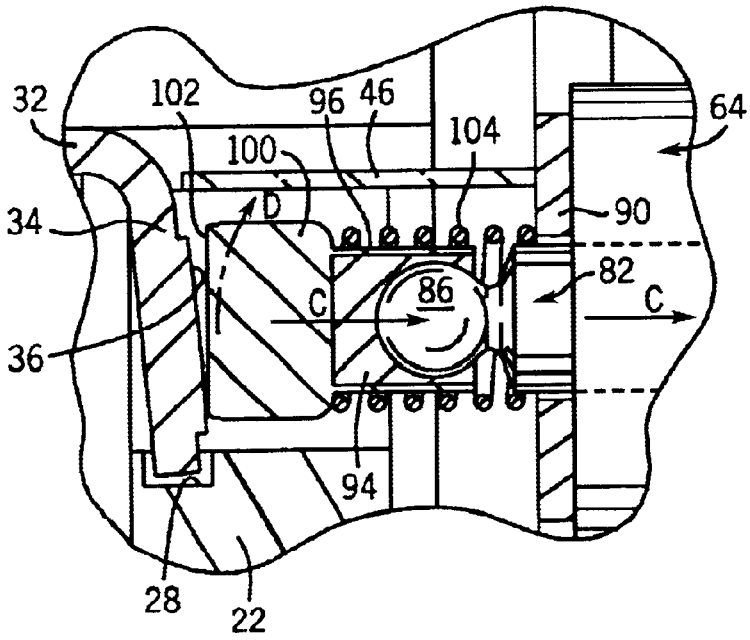
FIG. 9 is a view like FIG. 8 showing the contacts at the position just prior to break and initiation of the arc from the last touch position.

The relay 10 is brought to its open position (FIG. 5) with a momentary energization of the solenoid coil in a sense that produces a field that adds to the field of the permanent magnet 78. Once in its full open position the plunger 84 is held latched to the stop 80 by the force of the permanent magnet 78 alone, the power to the coil is removed, and the movable contacts 102 are spaced from the fixed contacts 36 and are disposed in a generally vertical attitude facilitated by the spring 104 acting against the back of the bridge assembly 100. To move to its operating or closed position (FIG. 7), the solenoid 64 is unlatched with a momentary energization of the solenoid coil in a sense that produces a field which opposes the field of the permanent magnet 78 and causes the plunger 84 to move out of the solenoid 64 as shown by the arrow A. As the plunger 84 moves from the solenoid 64, the ball joint arrangement permits the movable contacts 102 to drop (arrow A, FIG. 6) so that they eventually engage the downwardly angled plane of the fixed contacts 36 at an angle perpendicular thereto (FIG. 7). When it is desired to break the electrical connection, the solenoid 64 is energized momentarily in a sense that adds to the field of the permanent magnet 78 so that spring 104 will be compressed and the plunger 84 pulled in a reverse direction into the solenoid 64 as shown by the arrow B in FIG. 8. As the force is applied to the plunger, a torsional force will be applied to any weld which may have occurred between the contacts. As the plunger 84 continues to retract in the direction of arrow C, FIG. 9, the movable contacts 102 move upwardly and away in the direction of arrow D from the fixed contacts 36 due to the ball joint arrangement in a manner which causes final contact touch to occur at the edge of the contact close to the insulator. It should be appreciated that the angle of the fixed contacts 36 contributes to the effectiveness of the wiping action as well as to causing the arc to initiate in its optimum location for cooling (FIG. 10). Continued movement of the plunger 84 returns the movable contacts 102 to the open position as shown in FIG. 5.

In order to deal with the arcing which occurs when the movable contacts 102 and the fixed contacts 36 are moved towards or away from each other, the relay 10 relies upon the LEXAN polycarbonate insulator 16 which acts to expel gas caused by the arcing, the gas having a tendency to cool the arc. At the time the contacts are opening and the arc is initiated, a component of the magnetic field produced by the combined contributions of the permanent magnet and the actuation of the coil, passes through the plunger and extends past it through the current loop as shown in FIG. 10. The orientation of the field and current is such that a force is created on the current in the direction of the insulator 16 and its corresponding surfaces 18, 20, 22, for cooling. A further outward force, proportional to the current and due to the self field of the current in the current loop (FIG. 10) acts on the current until its extinction.

It should be appreciated that the present invention provides a high current relay which markedly lengthens the surface lifetime of its contacts by using a particular fabricated insulator to cool the arc, magnetic fields which support movement of the arc towards the insulator, and a ball joint supported movable contact assembly combined with an angled fixed contact structure to enable an effective wiping of the fixed contacts and optimum initial location of the arc.

While the invention has been described with reference to a preferred embodiment, those skilled in the art will appreciate that certain substitutions, and omissions may be made without departing from the spirit thereof. For example, although the preceding description discloses the magnetic fields facing in one particular direction, it should be understood that the fields may face in either direction. Accordingly, the foregoing description is meant to be exemplary only, and should not be deemed limitative on the scope of the invention set forth with the following claims.

I claim:

1. A relay subject to prolonged arcing when contacts are moved away from each other and momentary arcing at near touch of the contacts and during contact bounce, and susceptible to thin film tarnish, the relay comprising:

a solenoid having a coil and a plunger movable into and out of the solenoid;

a pair of fixed contacts;

a movable bridge assembly provided with a pair of movable contacts adapted to engage and disengage the fixed contacts upon respective application of power to the coil in a sense to unlatch and latch the plunger, the bridge assembly being connected via a ball joint arrangement to the solenoid plunger, the ball joint arrangement enabling the pair of movable contacts to move laterally relative to the fixed contacts causing wipe to occur between the fixed and movable contacts that removes thin film tarnish and additionally enabling a torsional force which aids in the breaking of welds;

a spring which holds the movable contacts against the stationary contacts when the plunger is unlatched and in one stable state; and a permanent magnet that holds the plunger latched against the opposing force of a spring in another stable state.

2. The relay of claim 1, including an insulator surrounding the movable contacts for cooling the arcing between the movable and fixed contacts.

3. The relay of claim 2, wherein the solenoid is supported in a generally rectangular frame having an end plate.

4. The relay of claim 3, wherein the fixed contacts are carried on outwardly and downwardly angled legs of a pair of generally L-shaped brackets.

5. The relay of claim 4, wherein the relay has a housing for supporting the solenoid in its frame, the insulator, the movable bridge assembly and the L-shaped brackets.

6. The relay of claim 1, wherein the plunger has a cylindrical portion and a spherical portion.

7. The relay of claim 6, wherein the spherical portion is received within a swivel cap attached to the movable bridge assembly to define a swivel arrangement for the movable contacts on the bridge assembly.

8. The relay of claim 2, wherein the insulator is constructed of LEXAN polycarbonate.

9. The relay of claim 5, wherein the relay housing has one cavity for holding the solenoid in its frame, and another cavity for holding the insulator, the movable bridge assembly and the angled legs of the L-shaped brackets.

10. The relay of claim 4, wherein the insulator is formed with pockets for receiving lowermost ends of the angled legs of the L-shaped brackets.

11. The relay of claim 4, wherein the L-shaped brackets include horizontal legs integrally connected to outwardly and downwardly angled legs.

12. The relay of claim 11, wherein the outwardly and downwardly angled legs are disposed at an angle of about 95 degrees relative to the horizontal legs.

13. The relay of claim 3, wherein the spring is a coil spring having one end disposed against the end plate and a second end disposed against a rearward end of the bridge assembly.

14. In a relay having a pair of fixed contacts, a pair of movable contacts adapted to be engaged and disengaged with the fixed contacts, and a solenoid having a plunger movable into and out of the solenoid, the plunger having an outer end operably connected to the movable contacts, the relay being subject to arcing when the movable contacts are moved relative to the fixed contacts, the improvement comprising:

a motion translating arrangement interconnecting the plunger and the movable contacts to enable wiping between the movable and fixed contacts and subsequent removal of thin film tarnish, the motion translating arrangement also contributing to a torsional force designed to break contact welds; and an insulator surrounding the movable contacts for cooling for arc, wherein the motion translating arrangement is a ball joint arrangement that provides for swivel movement of the movable contacts.

15. The improvement of claim 14, wherein the ball joint arrangement includes a spherical portion formed on one end of the plunger, a cylindrical swivel cap liner for receiving the spherical portion of the plunger, and a cylindrical swivel cap for receiving the liner, the swivel cap being attached to the movable contacts.

16. The improvement of claim 14, wherein the insulator includes a top wall overlying the movable contacts.

17. The improvement of claim 14, wherein the fixed contacts are carried on outwardly and downwardly angled legs which are received in a pair of pockets formed in the insulator.

18. The improvement of claim 14, wherein the insulator is constructed of a gas expelling material.

19. A relay comprising:

a solenoid having a coil and a plunger movable into and out of the solenoid;

a frame for holding the solenoid;

a pair of generally L-shaped brackets having horizontal legs integrally formed with outwardly and downwardly angled legs carrying a pair of fixed contacts;

a movable bridge assembly provided with a pair of movable contacts adapted to engage and disengage the fixed contacts upon respective application of power to the coil in a sense to unlatch and latch the plunger, the bridge assembly being connected via a ball joint arrangement to the solenoid plunger, the ball joint arrangement enabling the movable contacts to move laterally relative to the fixed contacts causing wipe to occur between them that removes thin film tarnish and additionally enabling a torsional force which aids in the breaking of welds;

a coil spring surrounding the ball joint arrangement and having one end disposed against the frame and another end disposed against the bridge assembly; and an insulator surrounding the movable contacts for cooling the arcing.

* * * * *